United States Patent [19]

Gold

[11] Patent Number: 4,480,520

[45] Date of Patent: Nov. 6, 1984

[54] ELECTRONIC AUDIO BLENDING SYSTEM

[76] Inventor: Kenneth S. Gold, 7721 Nevada Ave., Canoga Park, Calif. 91304

[21] Appl. No.: 460,281

[22] Filed: Jan. 24, 1983

[51] Int. Cl.[3] ..... G10H 1/08; G10H 3/18

[52] U.S. Cl. ..... 84/1.16; 84/1.15; 84/1.22

[58] Field of Search ..... 84/1.14–1.16, 84/1.11, 1.12, 1.19–1.22

[56] References Cited

U.S. PATENT DOCUMENTS 4,176,329 11/1979 Moskowitz ..... 84/1.22 X

*Primary Examiner*—Stanley J. Witkowski

*Attorney, Agent, or Firm*—J. E. McTaggart

[57] ABSTRACT

For controlling the blend between two pickups on an electric guitar, this circuitry provides, over the range of a single simple potentiometer, continuously variable blend between the two pickup signals in a particular phase relationship plus continuously variable blend of the two signals in a reversed phase relationship, eliminating the use of phasing switches, and providing musicians with a wide range of tonal variation under continuous control, for freedom of musical expression and timbre modification not available heretofore. Implementation with operational amplifier integrated circuits facilitates further processing of each pickup signal independently for special effects such as the introduction of controlled distortion.

9 Claims, 3 Drawing Figures

ELECTRONIC AUDIO BLENDING SYSTEM

BACKGROUND OF THE INVENTION

The present invention relates to controlling the blending of a pair of coherent audio signals, such as the signals from two pickups on an electric guitar. It has been known that musically desireable effects derive from mixing the output of two pickups placed at different distances along the strings of the guitar. Further, it has been found that additional tonal variety is available by reversing the relative phase between the two pickup signals. It has become common to provide some form of phase switch on the body of the guitar to enable the musician to make such phase reversal at will. However, such a switch, even when used in conjunction with separate volume and tone controls for each pickup, places certain constraints on the freedom of the musician to smoothly and conveniently vary the blend between the two pickups in both of the possible phase relationships while playing the instrument. The phasing switch of necessity, causes an abrupt transition between the two phase conditions.

SUMMARY OF THE INVENTION

Accordingly, it is an object of this invention to provide an improved electronic circuit for blending two audio signals in continously variable proportion in both of their possible phase relationships, over the range of a single potentiometer.

It is a further object of this invention to provide a wider range of tonal variety, controllable by a single potentiometer, than has been possible hitherto.

It is a further object of this invention to provide continuous blending of two pickups in both phase conditions over the range of a single common potentiometer.

It is yet a further object of this invention to provide the aforementioned capabilities of audio blending using common integrated operational amplifier circuits along with a minimal quantity of peripheral components.

DETAILED DESCRIPTION OF THE PREFERRED EMBODIMENT

Figure 1:
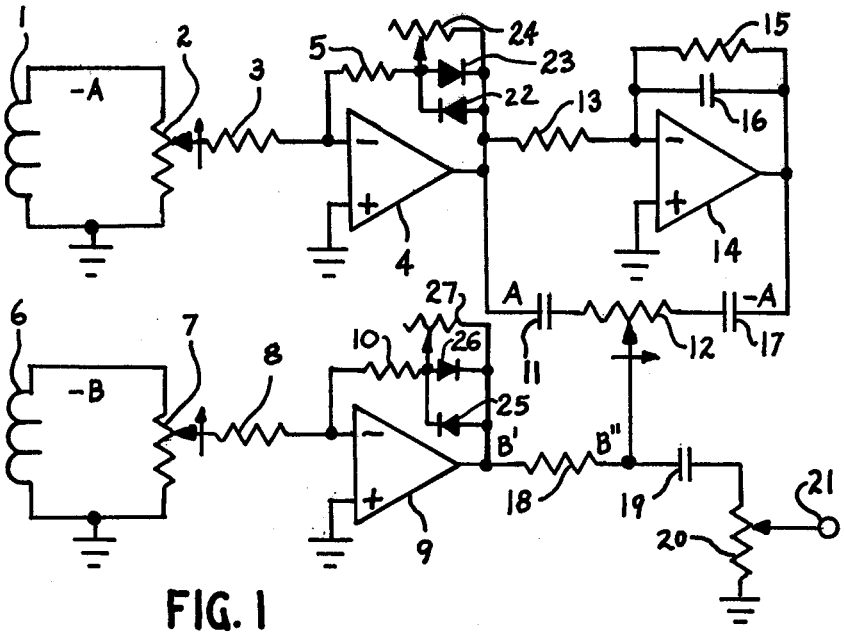
FIG. 1 is a schematic diagram showing two pickups of an electric guitar connected to circuitry including a blend potentiometer for controlling the blending of signals from the pickups.

In FIG. 1, the output of a first pickup of an electric guitar is connected to input potentiometer 2, thence thru resistor 3 to the inverting input of integrated operational amplifier circuit (op-amp) 4, having its non-inverting input grounded, and having a feedback resistor 5 in series with a parallel pair of oppositely polarized diodes, 22 and 23, the diodes being shunted by a variable resistor 24, connected between its output and its inverting input. Similarly, a second pickup 6 of the guitar supplies signal to the the second input potentiometer 7, thence thru resistor 8 to op-amp 9 having feedback resistor 10 in series with a parallel pair of oppositely polarized diodes 25 and 26 shunted by a variable resistor 27, connected between its output and its inverting input.

The output of op-amp 4 is connected thru capacitor 11 to a first end terminal of blend potentiometer 12, and also thru resistor 13 to the inverting input of op-amp 14 having feedback resistor 15 and capacitor 16 connected between its output and its inverting input. The output of op-amp 14 is connected thru capacitor 17 to a second end terminal of blend potentiometer 12, whose rotor terminal is connected thru resistor 18 to the output of op-amp 9, and thru capacitor 19 to the output potentiometer 20 having its rotor terminal connected to output terminal 21.

Component values in the illustrative embodiment are as follows:

Capacitors: 11, 17—0.22 uF
16—47 pF
19—0.1 uF
Resistors: 3, 5, 8,
13, 15, 18—100 kohms
10—510 kohms
Variable Resistors: 24, 27—500 kohms, 5% taper
Potentiometers: 2, 7—100 kohms, audio
12—100 kohms, linear
20—500 kohms, audio
I.C. Op-amps: 4, 9, 14—TL062
Diodes: 22, 23, 25, 26—1N4148

Capacitors 11, 17 and 19 block any d.c. offset voltages which may develop at the outputs of op-amps 4, 14 and 9, to keep such d.c. voltages from reaching potentiometers 12 and 21, to avoid potential noise problems. The capacitance values chosen are large enough that the reactance introduced at the lowest audio frequencies of interest may be considered so small as to have no effect on circuit performance.

Capacitor 16 serves to provide high frequency compensation for inverter op-amp 14.

In the following descriptive analysis, it is to be assumed until stated otherwise that variable resistors 24 and 27 are set to their minimum resistance value, thereby effectively short-circuiting diodes 22, 23, 25 and 26, whereby under this condition the diodes can have no influence on the performance of the circuit.

Figure 2:
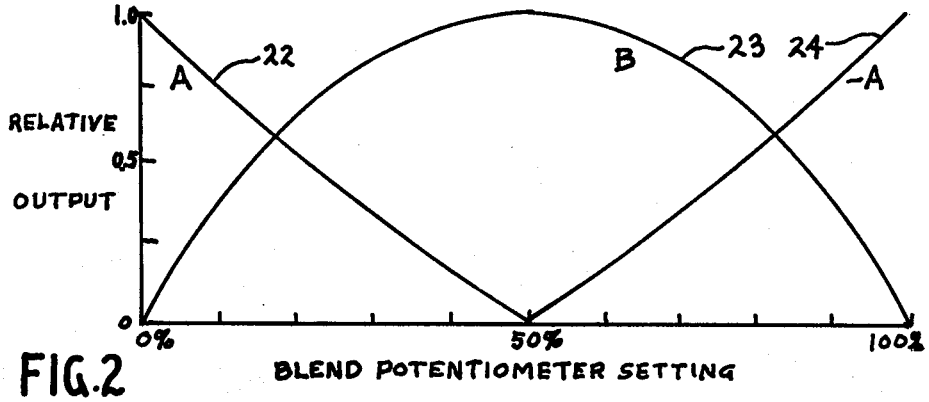
FIG. 2 is a graph of the relative response from each pickup of FIG. 1, plotted as a function of the rotational position of the potentiometer rotor.

Analysis of the circuit of FIG. 1 will show that as the setting of the blend potentiometer 12 is varied the relative amplitude and phase of signals from the two pickups as they appear at the output 21 will vary proportionately as shown in the graph of FIG. 2, as follows:

At 0% rotation, corresponding with the left hand extreme of potentiometer 12 in FIG. 1, the full output of op-amp 4, carrying signal A from pickup 1 will appear at the output potentiometer 20; however the output of op-amp 9, carrying signal B from pickup 6 will be almost completely attenuated due to the voltage division between resistor 18 (100 kohms) and the low output impedance of op-amp 4 (under 10 ohms). This is shown by curves 22 and 23 of FIG. 2, at the 0% rotation setting.

Similarly, at 100% rotation, as shown in FIG. 2, only the inverted version of signal A from op-amp 14 will appear at the output potentiometer 20, as shown in curves 23 and 24.

With the rotor of blend potentiometer 12 set to 50% rotation, the center of its range, the signals at each end, being equal in amplitude but opposite in phase, will cancel each other, consequently signal A will be almost completely attenuated; however signal B will reach a maximum amplitude at this setting because the impedance to ground from the rotor of blend potentiometer 12 reaches its maximum value, approximately 24 kohms, formed by the parallel combination of output potentiometer 20 (500 kohms), and the parallel combination of the two halves of the blend potentiometer 12 (each 50 kohms), At this center setting, the attenuation of the B signal thru resistor 18 is 24 k/(24 k+R18)=24/124=1/5.16. To compensate for this attenuation, the resistance of feedback resistor 10 is chosen to make op-amp 9 have a gain of approximately R10/R8=510 k/100 k=5.1, so that the overall gain for signal B at the center setting of the blend potentiometer 12 is nominally equal to the gain for signal A at 0% and 100% settings, as shown in FIG. 2, curves 22, 23 and 24.

It should be apparent that, in addition to the three conditions described, for 0%, 50% and 100% rotation, which result in pure unmixed signals of A, B, and −A respectively, intermediate settings of blend potentiometer 12 will result in a blend of A and B for settings between 0% and 50%, and will result in a blend of −A and B for settings between 50% and 100%, as shown in FIG. 2. It can be calculated that for the component values used, there is a setting around 20% rotation where the blend will be 0.6A+0.6B, and similarly around 80% rotation the blend will be −0.6A+0.6B, corresponding to the two crossover points in the curves of FIG. 2. The −0.6A+0.6B blend is of particular significance musically, since there will be substantial cancellation of the fundamental frequencies of the signals from the two pickups, resulting in harmonically rich musical timbre desired for certain styles of musical performance.

Input potentiometers 2 and 7 may be screwdriver adjusted for presetting the relative contributions of pickups 1 and 6, in effect "tailoring" the action of the blend control to individual preference.

Output potentiometer 20 serves as a master volume control for setting the level of the blended output signal at terminal 21.

Figure 3:
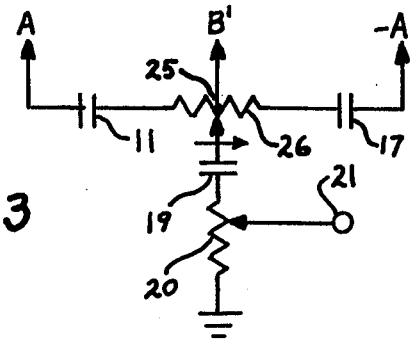
FIG. 3 is a schematic diagram of an alternative blend potentiometer circuit using a center tapped potentiometer.

FIG. 3 shows an optional circuit for the blend potentiometer where the signal from the B channel is applied to the blend potentiometer 26 by means of a center tap 25 while the A and −A signals are applied to the two end terminals as in FIG. 1. Resistor 18 may be eliminated and the output of op-amp 9 may be connected directly to the tap 25, and resistor 10 may be changed to 100 kohms for unity gain. The circuit modified as in FIG. 3 performs closely to that of FIG. 1, except that the curves of FIG. 2 will become more linear and the crossovers will be closer to 25% and 75%. However the circuit of FIG. 1 was selected for the ready availability and low cost of the untapped potentiometer 12 and the subjectively desireable blend control action in musical performance.

When variable resistor 24 is adjusted away from the minimum setting heretofore assumed, and set to a relatively high resistance value, diodes 22 and 23 are no longer short-circuited and their non-linearities are introduced into the negative feedback path of amplifier 4, adding harmonic distortion to signals present in amplifier 4, originating from pickup 1, to introduce controllable amounts of such distortion into signal A for a richer variety of musical timbre effects. Similarly, when variable resistor 27 is adjusted away from its minimum setting heretofore assumed, diodes 25 and 26 are permitted to introduce controllable distortion into signal B. A musician is thus enabled to introduce a chosen amount of harmonic distortion into either signal A or signal B, or both, and to blend signals A and B as desired, by adjusting blend potentiometer 12, to achieve an unprecedented range of readily controlled tonal effects.

In the preferred embodiment, variable resistors 24 and 27 are configured with knobs and mounted on a guitar body for manual operation; however, as an alternative configuration, one or both variable resistors 24 and 27 may be adapted for footpedal operation.

These and other modifications, variations and adaptations which may become apparent to those of skill in the art are intended to be included within the scope and spirit of this invention.

What is claimed is:

1. In an electric guitar having at least a first pickup and a second pickup, each capable of producing electrical signal output, a circuit for blending the signal outputs from each of the two pickups and for controlling the proportions of the blending, comprising:

(a) a blend potentiometer having at least a first end terminal, a rotor terminal and a second end terminal;

(b) means for applying a signal derived from the first pickup to the first end terminal;

(c) means for applying a signal derived from the first pickup to the second end terminal in phase opposition to the signal applied to the first end terminal;

(d) means for conductivity coupling a signal derived from the second pickup to the rotor terminal;

whereby an output signal derived at the rotor terminal contains over a first half of its range, a variable blend of signal derived from the first pickup and signal derived from the second pickup, substantially in phase with each other, and over a second half of its range, a variable blend of signal derived from the first pickup and signal derived from the second pickup, substantially out of phase with each other.

2. The invention as in claim 1 wherein:

the means for applying a signal derived from the first pickup to the first end terminal comprises a first integrated operational amplifier circuit, and the means for applying a signal derived from the first pickup to the second end terminal comprises a second integrated operational amplifier circuit, connected as a unity gain inverter obtaining input from an output of the first integrated operational amplifier circuit.

3. The invention as in claim 2 wherein the means for conductivity coupling a signal derived from the second pickup to the rotor terminal comprises a resistor connected between the rotor terminal and an output of a third integrated operational amplifier circuit receiving an input signal derived from the second pickup.

4. The invention as in claim 2 wherein the means for conductivity coupling a signal derived from the second pickup to the rotor terminal comprises a center tap terminal on said potentiometer, the center tap terminal being connected to an output of a third integrated operational amplifier circuit receiving an input signal derived from the second pickup.

5. The invention as in claim 3 further comprising an output potentiometer having a first end connected to a common ground, a second end terminal electrically coupled to the rotor terminal of the blend potentiometer, and a rotor terminal supplying a blended output signal.

6. The invention as in claim 5 further comprising a first coupling capacitor connected in series with the first end terminal of the blend potentiometer, a second coupling capacitor connected in series with the second end terminal of the blend potentiometer, and a third coupling capacitor connected between the rotor terminal of the blend potentiometer and the second end terminal of the output potentiometer.

7. The invention as in claim 3 further comprising a first input potentiometer having end terminals connected across the first pickup and a rotor terminal connected thru a resistor to an input of the first integrated operational amplifier circuit, and a second input potentiometer having end terminals connected across the second pickup and a rotor terminal connected to an input of the third integrated operational amplifier circuit.

8. The invention as in claim 2 further comprising a variable distortion-controlling circuit, connected in a negative feedback path between an output and an inverting input of the first integrated operational amplifier circuit, having a resistor in series with the parallel combination of two oppositely polarized diodes and a variable resistor.

9. The invention as in claim 3 further comprising a variable distortion-controlling circuit, connected in a negative feedback path between an output and an inverting input of the third integrated operational amplifier circuit, having a resistor in series with the parallel combination of two oppositely polarized diodes and a variable resistor.

* * * * *